US008991066B2

(12) United States Patent
Goemans

(10) Patent No.: US 8,991,066 B2
(45) Date of Patent: Mar. 31, 2015

(54) DRYER AIR CIRCULATION ADAPTOR AND FILTER AND FILTER BYPASS ASSEMBLY

(76) Inventor: Bradley J. Goemans, Winona (CA)

( * ) Notice: Subject to any disclaimer, the term of this patent is extended or adjusted under 35 U.S.C. 154(b) by 1072 days.

(21) Appl. No.: 13/034,691

(22) Filed: Feb. 24, 2011

(65) Prior Publication Data

US 2011/0209353 A1 Sep. 1, 2011

Related U.S. Application Data

(63) Continuation-in-part of application No. 12/714,007, filed on Feb. 26, 2010.

(51) Int. Cl.

| | |
|---|---|
| ***F26B 21/06*** | (2006.01) |
| ***F26B 3/00*** | (2006.01) |
| ***D06F 58/22*** | (2006.01) |
| ***D06F 58/02*** | (2006.01) |
| ***D06F 58/20*** | (2006.01) |

(52) U.S. Cl.

CPC ..... *D06F 58/22* (2013.01); *D06F 58/02* (2013.01); *D06F 58/20* (2013.01)

USPC ..... 34/82; 34/480

(58) Field of Classification Search

USPC ..... 34/235, 218, 443, 82, 480; 210/264

See application file for complete search history.

(56) References Cited

U.S. PATENT DOCUMENTS

| | | | | |
|---|---|---|---|---|
| 5,435,377 | A | 7/1995 | Kratochvil | |
| 6,997,966 | B2 | 2/2006 | Iantorno | |
| 2007/0251117 | A1 | 11/2007 | Blount | |
| 2008/0110041 | A1 | 5/2008 | Ehlers | |
| 2008/0110044 | A1 | 5/2008 | Ehlers | |
| 2008/0113609 | A1 * | 5/2008 | Ehlers | 454/241 |
| 2009/0205220 | A1 | 8/2009 | Dewald, III et al. | |
| 2009/0277034 | A1 | 11/2009 | Wilson | |
| 2010/0011936 | A1 * | 1/2010 | Dennis | 84/313 |

* cited by examiner

*Primary Examiner* — Kenneth Rinehart
*Assistant Examiner* — John McCormack
(74) *Attorney, Agent, or Firm* — Steven M. Greenberg; CRGO Law

(57) ABSTRACT

An adaptor can convert a conventional hot air clothes dryer to draw air from outside instead of inside a building, and comprises an adaptor housing securable over the air intake region of the dryer in fluid communication with the air inlet of the dryer, with an adaptor housing inlet connectable to an air intake linkage. A filter and filter bypass assembly can be used in combination with the adaptor. The assembly comprises an outer enclosure and an inner enclosure inside the outer enclosure. An inner enclosure inlet and inner enclosure outlet define a first airflow path through the inner enclosure and an outer enclosure inlet and outer enclosure outlet define a second airflow path through the outer enclosure and bypassing the inner enclosure. The inner enclosure and the outer enclosure have a common aperture for insertion of a filter into the inner enclosure across the first airflow path.

5 Claims, 18 Drawing Sheets

DRYER AIR CIRCULATION ADAPTOR AND FILTER AND FILTER BYPASS ASSEMBLY

CROSS-REFERENCE TO RELATED APPLICATION

This application is a continuation-in-part of U.S. patent application Ser. No. 12/714,007 filed on Feb. 26, 2010, the teachings of which are hereby incorporated by reference.

FIELD OF THE INVENTION

The present invention is directed to clothes dryers, and more particularly to air intake adaptors for hot-air clothes dryers.

BACKGROUND OF THE INVENTION

A conventional hot-air clothes dryer operates by drawing air from the room in which it is located, heating the air, circulating the heated air among wet or damp clothes to absorb moisture from the clothes, and then venting the heated, moist air to the outside of the building (typically a dwelling) in which the clothes dryer is located.

Referring now to FIG. 1A, an exemplary prior art hot-air clothes dryer is indicated generally by the reference numeral 10A. The dryer 10A comprises a dryer housing 12A which includes a dryer air inlet 14A and a dryer air outlet 16A. The dryer 10A also includes a heater 18A, a pump 20A (in the illustrated embodiment a fan 22A driven by a motor 24A), and a driven rotating tumbler drum 26A which has drum air inlet apertures 28A located at the rear thereof. In the illustrated embodiment, the motor 24A also drives the tumbler drum 26A by way of a drive belt 30A. The dryer housing 12A also includes a door 32A enabling clothes to be placed inside the tumbler drum 26A through an open front end thereof. The door 32A is hollow and has door air inlet apertures 34A defined in its inner face so that the interior volume of the tumbler drum 26A can communicate with the interior of the door 32A, and a door outlet 36A which communicates through a lint trap 38A with the fan 22A. The fan 22A is positioned downstream of the dryer air inlet 14A, heater 18A, tumbler drum 26A, door 32A and lint trap 38A, and upstream of the dryer air outlet 16A, which communicates with the building exterior through a vent passage 40A formed by tubing that extends through an exterior wall 42A of the building.

In operation of the exemplary dryer 10A, the fan 22A draws air, denoted by the arrows 44, into the dryer housing 12A through the dryer air inlet 14A. The air 44 is drawn past the heater 18A, which heats the air 44, and then through the drum air inlet apertures 28A into the tumbler drum 26A. Inside the tumbler drum 26A, the heated air 44 absorbs moisture from the clothing (not shown) as the tumbler drum 26A rotates, and then the heated, moist air 44 passes through the door air inlet apertures 34A into the hollow interior of the door 32A. The heated, moist air 44 is then drawn through the door outlet 36A and the lint trap 38A, which captures fibers carried by the heated, moist air 44, and then continues past the fan 22A through the vent passage 40A to the exterior of the building.

FIG. 1B shows an exemplary prior art hot-air clothes dryer 12B which is identical to the exemplary prior art dryer 12A except that the dryer air inlet, denoted by reference numeral 14B, is located at a dryer air intake region at the rear of the dryer 12B, rather than at the front as with the exemplary prior art dryer 12A, and comprises a plurality of apertures 15B. As such, identical reference numerals, except with the suffix "B" instead of "A", are used to denote corresponding features.

With hot-air clothes dryers such as those described above, it is important that the heated, moist air be vented to the outside of the building, otherwise the moisture can result in the development of mould or otherwise damage the building.

As more and more buildings, and particular houses, become well insulated and effectively sealed from the outside environment when the doors and windows are closed, the drawing of air from inside the room can be problematic, since the insulation and sealing impedes the inflow of replacement air into the building.

Proposals have been made for a dryer which draws air from the outside of the building rather than from inside the building. For example, U.S. Patent Application Publications No. 2008/0110044, 2008/0113609 and 2008/0110041 in the name of Gregory Ehlers, each of which is hereby incorporated by reference, teach a dryer which is constructed to draw air from outside of the building in which it is located.

FIG. 2 shows an exemplary hot-air clothes dryer 210 which is designed to draw air from outside of the building in which it is located. The first exemplary dryer 210 is similar to the exemplary prior art clothes dryer 10B, and comprises a dryer housing 212 which includes a dryer air inlet 214 and a dryer air outlet 216. Like the prior art dryer 10B, the first exemplary dryer 210 comprises a heater 218, a pump 220 comprising a fan 222 driven by a motor 224, as well as a driven rotating tumbler drum 226 having drum air inlet apertures 228 located at the rear thereof, with the motor 224 also driving the tumbler drum 226 by way of a drive belt 230. As with the prior art dryer 10B, a hollow door 232 permits access to the tumbler drum 226, and includes door air inlet apertures 234 enabling air 244 inside the interior volume of the tumbler drum 226 to communicate through the interior of the door 232, door outlet 236 and a lint trap 238 with the fan 222. Like the prior art dryer 10B, when installed for use the first exemplary dryer 210 is located inside a building, adjacent a wall 242 thereof.

Unlike the illustrated prior art dryer 10B shown in FIG. 1B, which draws air from inside the room in which it is situated, when installed the exemplary prior art dryer 210 shown in FIG. 2 will draw intake air directly from the exterior of the building in which the dryer 210 is located.

As shown in FIG. 2, the dryer air inlet 214 communicates along an intake air passage 246 defined by a linkage 247 with an inlet aperture 248 disposed outside of the building in which the first exemplary dryer 210 is situated so as to receive air directly from outside the building. Similarly, the dryer air outlet 216 communicates along an output air passage 250 defined by a linkage 251 with an outlet aperture 252 disposed outside of the building to vent the heated moist air to the outside. The intake air passage 246 and the output air passage 250 are arranged concentrically, with a portion of the linkage 251 defining the output air passage 250 disposed within, and surrounded by, a corresponding portion of the linkage 247 defining the intake air passage 246 and supported by spokes 260.

The dryer air inlet 214 is in communication along a heated path with a drying chamber; air entering through the dryer air inlet 214 is drawn past the heater 218 into the tumbler drum 226. The dryer air outlet 216 is in communication with the drying chamber and, via an output air path, with an outlet aperture disposed outside of the building. In the first exemplary dryer 210, air from the tumbler drum 226 is drawn into the door air inlet apertures 234, through the interior of the door 232, door outlet 236 and lint trap 238 to the dryer air outlet 216 and then along the output air passage 250 defined by the linkage 251 to an outlet aperture 252 disposed outside of the building. The pump 220 comprising the motor 224 and fan 222 moves air, denoted by arrows 244, from the inlet aperture 248, along the intake air passage 246 to the dryer air inlet 214, along the heated path, that is, past the heater 218, and through the drying chamber, in this case the tumbler drum 226, to the dryer air outlet 216, and then along the output air passage 250 to the outlet aperture 252.

While dryers which are designed to draw air from outside of the building in which the dryer is located may avoid the problem of drawing air from inside a well-insulated and well-sealed structure, they must replace an existing dryer which may be in perfectly good working order. The cost of such replacement would serve as a significant deterrent to adoption, and even when the cost does not deter replacement, there is waste because the previous dryer will be discarded even if it still has many years of useful life.

In addition, where a dryer that draws intake air directly from the exterior of the building in which the dryer is located includes an intake air passage and output air passage that are concentrically arranged, as with the dryer 210, such dryers cannot be easily adapted to the external lint traps commonly used in multi-unit residential buildings, such as condominiums and apartment buildings. Such lint traps are typically housed in the wall or ceiling of the room in which the dryer is located to remove lint that was not captured by the lint trap in the dryer itself. An example of such a lint trap is taught by U.S. Pat. No. 6,997,966 to Iantorno, the teachings of which are hereby incorporated by reference. FIG. 7A shows a dryer 710 inside a room 702 which has walls 704 and a ceiling 706. The air outlet 716 of the dryer 710 is coupled to an exhaust duct 714 running through the wall 704 and ceiling 706 to an exhaust vent 718. A lint trap 720 of the type taught by U.S. Pat. No. 6,997,966 to Iantorno is also disposed in the wall or ceiling and is interposed between two sections of the exhaust duct 714. Although two lint traps 720 are shown in FIG. 7A for purposes of illustration, with one lint trap 720 in the ceiling 706 and one lint trap 720 in the wall 704, typically a dryer installation will have only one lint trap, located in either the wall or the ceiling. As shown in FIG. 7B, the lint trap 720 comprises a filter enclosure 730 in the form of a rectangular parallelepiped having one open face 732 and a filter door 734 having a filter member 736 mounted diagonally thereon. The filter enclosure 730 has an enclosure inlet 738 and an enclosure outlet 740 which are opposed to one another and can be connected to the sections of the exhaust duct 714, as shown in FIG. 7A. The filter member 736 is slidingly received in the filter enclosure 730 through the open face 732 so that the filter member 736 lies across the airflow path from the enclosure inlet 738 to the enclosure outlet 740, with the side edges 742 of the filter member 736 engaging inner corners of the enclosure 730 and the filter door 734 closing the open face 732 to complete the enclosure 730. The filter door 734 and filter member 736 can be removed for cleaning or replacement of the filter member 736. A dryer that draws intake air directly from the exterior of the building in which the dryer is located and which includes an intake air passage and output air passage that are concentrically arranged cannot easily be used with a conventional lint trap such as that taught by U.S. Pat. No. 6,997,966 to Iantorno, such as the lint trap 720, because the filter member (e.g. filter member 736) would interfere with the flow of air to the dryer from outside the building.

SUMMARY OF THE INVENTION

The present invention provides adaptors so that a conventional hot air clothes dryer that draws air from within the room in which it is located can be converted to draw air from outside of the building, and also provides a filter and filter bypass assembly to enable the use of an external filter.

In one aspect, the present invention is directed to a hot-air clothes dryer and adaptor combination. The hot-air clothes dryer in the combination comprises a dryer air intake disposed at a dryer air intake region to define a dryer air inlet, with the dryer air inlet being in fluid communication along a heated path with a drying chamber, and further comprises a dryer air outlet in fluid communication with the drying chamber and connectible in fluid communication along an output air passage with an outlet aperture disposed outside of the building, and a pump for moving air into the dryer air inlet, along the heated path and through the drying chamber to the dryer air outlet, and along the output air passage to the outlet aperture. The adaptor is secured to the dryer and comprises an adaptor housing having an adaptor housing inlet and which is secured over the air intake region of the dryer to be in sealed fluid communication with the dryer air inlet.

In one embodiment, the adaptor further comprises an air intake linkage having a first end secured to the adaptor housing inlet so as to be in sealed fluid communication with the dryer air inlet and a second end defining an inlet aperture, with the inlet aperture being in fluid communication with the first end of the air intake linkage to define an intake air passage therebetween. The air intake linkage can cooperate with an aperture in an exterior building wall to position the inlet aperture to receive air only from outside the building. In a particular embodiment, an air output linkage has a first end secured in sealed fluid communication with the dryer air outlet and a second end defining an outlet aperture, with the first end of the air output linkage in fluid communication with the outlet aperture to define an output air passage that is isolated from the intake air passage. In one preferred embodiment, the adaptor housing is simultaneously sealingly secured over both the air intake region of the dryer and a dryer air outlet region of the dryer in which the dryer air outlet is located, the first end of the air output linkage is secured in sealed fluid communication with the dryer air outlet inside the adaptor housing, and the second end of the air output linkage is disposed outside the adaptor housing. Preferably, the intake air passage and the output air passage each include concentrically arranged portions.

In another aspect, the present invention is directed to an adaptor for a hot-air clothes dryer. The adaptor comprises an adaptor housing securable over an air intake region of the dryer to be in sealed fluid communication with an air inlet of the dryer. The adaptor housing has an adaptor housing inlet connectible in sealed fluid communication with an air intake linkage. The adaptor may further comprise an air intake linkage whose first end is secured to the adaptor housing inlet so as to be in sealed fluid communication with the dryer air inlet and whose second end defines an inlet aperture that is in fluid communication with the first end of the air intake linkage to define an intake air passage therebetween. The air intake linkage can cooperate with an aperture in an exterior building wall to position the inlet aperture to receive air only from outside the building. The adaptor may still further comprise an air output linkage whose first end is securable in sealed fluid communication with a dryer air outlet of the dryer and whose second end defines an outlet aperture, with the first end of the air output linkage in fluid communication with the outlet aperture to define an output air passage that is isolated from the intake air passage. In one preferred embodiment, the adaptor housing is simultaneously sealingly securable over both the air intake region of the dryer and over a dryer air outlet region of the dryer, the first end of the air output linkage is securable in sealed fluid communication with the dryer air outlet inside the adaptor housing, and the second end of the air output linkage is disposed outside the adaptor housing. Preferably, the intake air passage and the output air passage each include concentrically arranged portions.

The present invention is also directed to an adaptor kit comprising an adaptor as described above and instructions for assembling the adaptor and mounting the adaptor on the dryer.

In a further aspect, the present invention is directed to a filter and filter bypass assembly comprising an outer enclosure and an inner enclosure inside the outer enclosure. The inner enclosure has an inner enclosure inlet and an inner enclosure outlet defining a first airflow path through the inner enclosure and the outer enclosure has an outer enclosure inlet and an outer enclosure outlet defining a second airflow path through the outer enclosure and bypassing the inner enclosure. The inner enclosure and the outer enclosure have a common aperture for insertion of a filter into the inner enclosure across the first airflow path. The filter and filter bypass assembly may further comprise a filter member slidingly received in the inner enclosure with edges of the filter member engaging inner surfaces of the inner enclosure, with the filter member secured to a filter door so that when the filter member is inserted into the inner enclosure, the filter door closes the common aperture.

The filter and filter bypass assembly may further comprise a first air output linkage sealingly coupled to the inner enclosure inlet and a second air output linkage sealingly coupled to the inner enclosure outlet, and may still further comprise a first air intake linkage sealingly coupled to the outer enclosure inlet and a second air intake linkage sealingly coupled to the outer enclosure outlet. Preferably, a portion of the first air output linkage disposed outside of the outer enclosure is disposed inside the first air intake linkage and a portion of the second air output linkage disposed outside of the outer enclosure is disposed inside the second air intake linkage.

In other aspects, the present invention is directed to a system incorporating the above-described adaptor and the above-described filter and filter bypass assembly, and to a dual-passage end cap for use with a system incorporating the above-described adaptor.

BRIEF DESCRIPTION OF THE DRAWINGS

These and other features of the invention will become more apparent from the following description in which reference is made to the appended drawings wherein.

DETAILED DESCRIPTION

Figure 3:
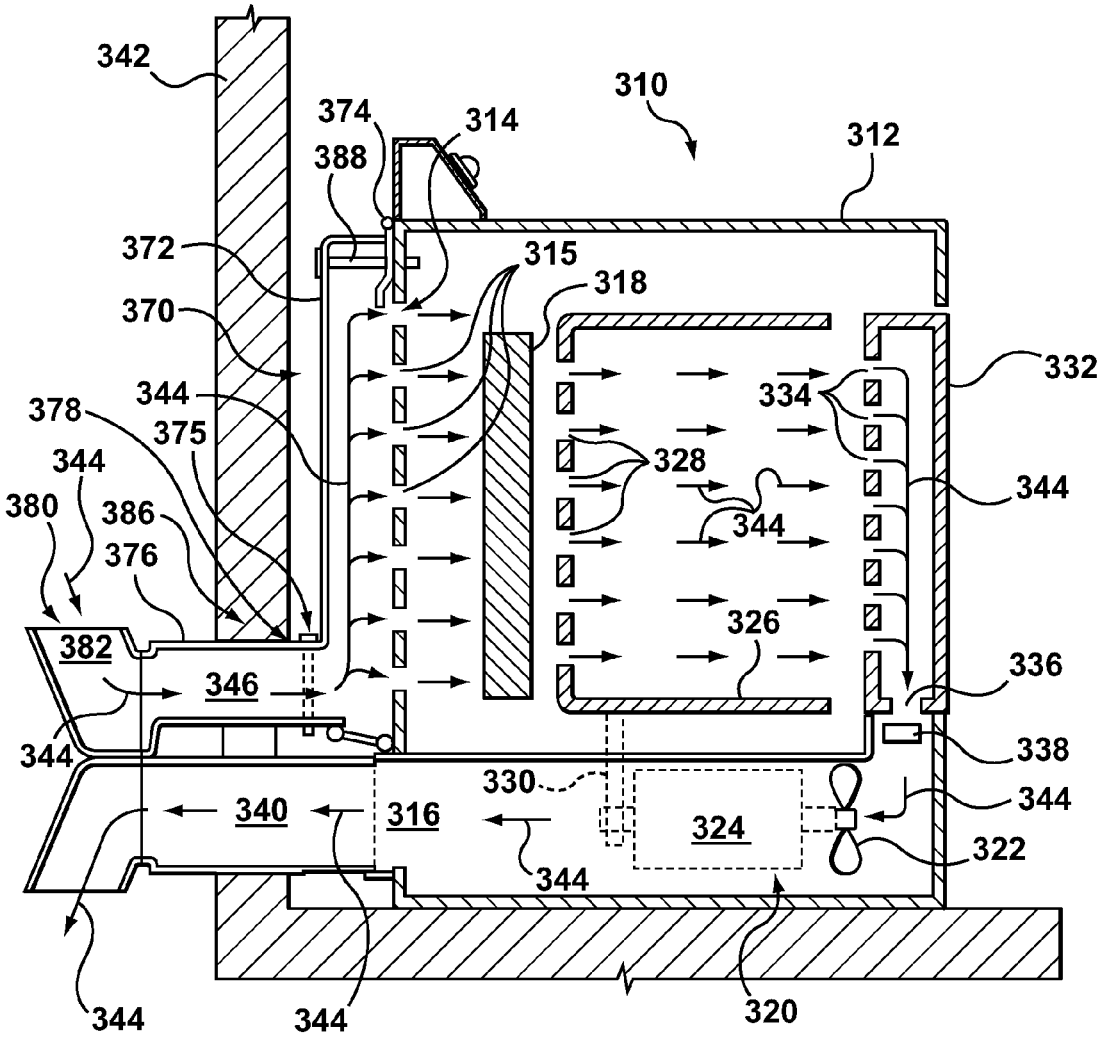
FIG. 3 is a schematic cross-sectional view of a first exemplary embodiment of an adaptor according to an aspect of the present invention secured to a conventional hot-air clothes dryer, shown in its surrounding environment.

With reference now to FIG. 3, a first exemplary adaptor for adapting a prior art hot-air clothes dryer to function in accordance with aspects of the present invention is indicated generally by the reference numeral 370, and is shown secured to an exemplary prior art clothes dryer 310. The prior-at clothes dryer 310 is identical to the prior art clothes dryer depicted in, and described in respect of, FIG. 1B, and accordingly corresponding reference numerals are used to denote corresponding features, except with the prefix "3" and without the suffix "B". The flow of air is denoted by arrows 344.

The first exemplary adaptor 370 comprises an adaptor housing 372 securable over the air intake region in which the air inlet 314 of the dryer 310 is located, that is, over the apertures 315 comprising the air inlet 314 of the dryer 310. The adaptor housing 372 may be secured over the air intake region by any suitable means, including without limitation magnets and bolts, and is preferably removably secured over the air intake region. In the embodiment shown in FIG. 3, bolts 388 are used to secure the adaptor housing 372. The adaptor housing 372, when secured over the air intake region, is in sealed engagement with the dryer 310, and such seal may be achieved by any suitable technique. In the illustrated embodiment, sealing between the adaptor housing 372 and the dryer 310 is achieved by way of a resilient gasket 374 disposed on the mating surface of the adaptor along the outer edge thereof.

An adaptor housing inlet 375 is connectable in sealed fluid communication with an air intake linkage 376. The air intake linkage 376 has a first end 378 that can be sealingly secured to the adaptor housing inlet 375 in fluid communication therewith, as shown in FIG. 3, and therefore in sealed fluid communication with the dryer air inlet 314. The air intake linkage 376 has a second end 380 defining an inlet aperture 382. The inlet aperture 382 is in fluid communication with the first end 378 of the air intake linkage 376 to define an intake air passage 346 therebetween. As such, when the adaptor 370 is secured to the dryer 310 and the air intake linkage 376 is secured to the adaptor housing inlet 375, the inlet aperture 382 defined by the second end 380 of the air intake linkage 376 is in sealed fluid communication with the dryer air inlet 314.

The air intake linkage 376 is extendible through an aperture 386 in the exterior building wall 342 to position the inlet aperture 382 exteriorly of the exterior building wall 342 to receive air from outside the building. The air intake linkage 376 may be a rigid linkage or a flexible linkage.

Accordingly, where a prior art hot-air dryer such as the dryer 310 is equipped with an adaptor according to an aspect of the present invention, such as the first exemplary adaptor 370, operation of the combined dryer 310 and adaptor 370 will be as follows. The fan 322 draws air, denoted by the arrows 344, directly from outside of the building. In particular, the fan 322 draws air 344 into the inlet aperture 382 defined by the second end 380 of the air intake linkage 376, along the air intake linkage 376, through the first end 378 of the air intake linkage 376 and the adaptor housing inlet 375, into the adaptor housing 372 and through the dryer air inlet 314 into the dryer housing 312. The dryer 310 itself operates in the conventional manner; once inside the dryer 310 the air 344 is drawn past the heater 318, through the drum air inlet apertures 328 into the tumbler drum 326, through the door air inlet apertures 334 into the hollow interior of the door 332, through the door outlet 336 and the lint trap 338, and then past the fan 322 through the vent passage 340 to the exterior of the building.

In the first exemplary adaptor 376 shown in FIG. 3, the air intake linkage 376 is separate from, and extends through a different aperture in the exterior wall 342 than, the vent passage 340 that is defined by the outlet linkage secured at the dryer air outlet 316 and extends through the exterior wall 342 of the building. As such, it will not interfere with an existing installation of an external lint trap, although it will require an additional aperture 386 to be formed in the exterior building wall 342.

Figure 4:
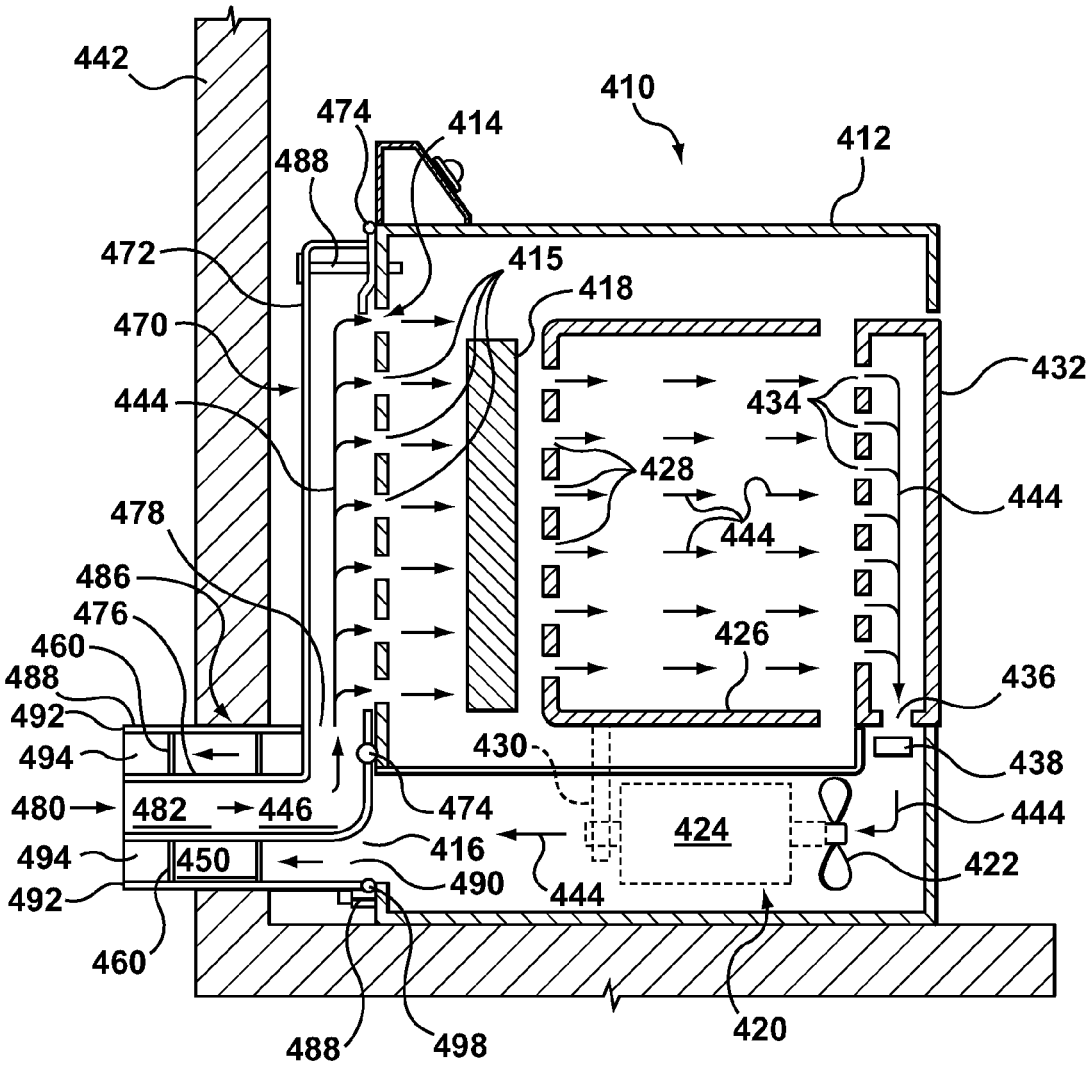
FIG. 4 is a schematic cross-sectional view of a second exemplary embodiment of an adaptor according to an aspect of the present invention secured to a conventional hot-air clothes dryer, shown in its surrounding environment.
Figure 5:
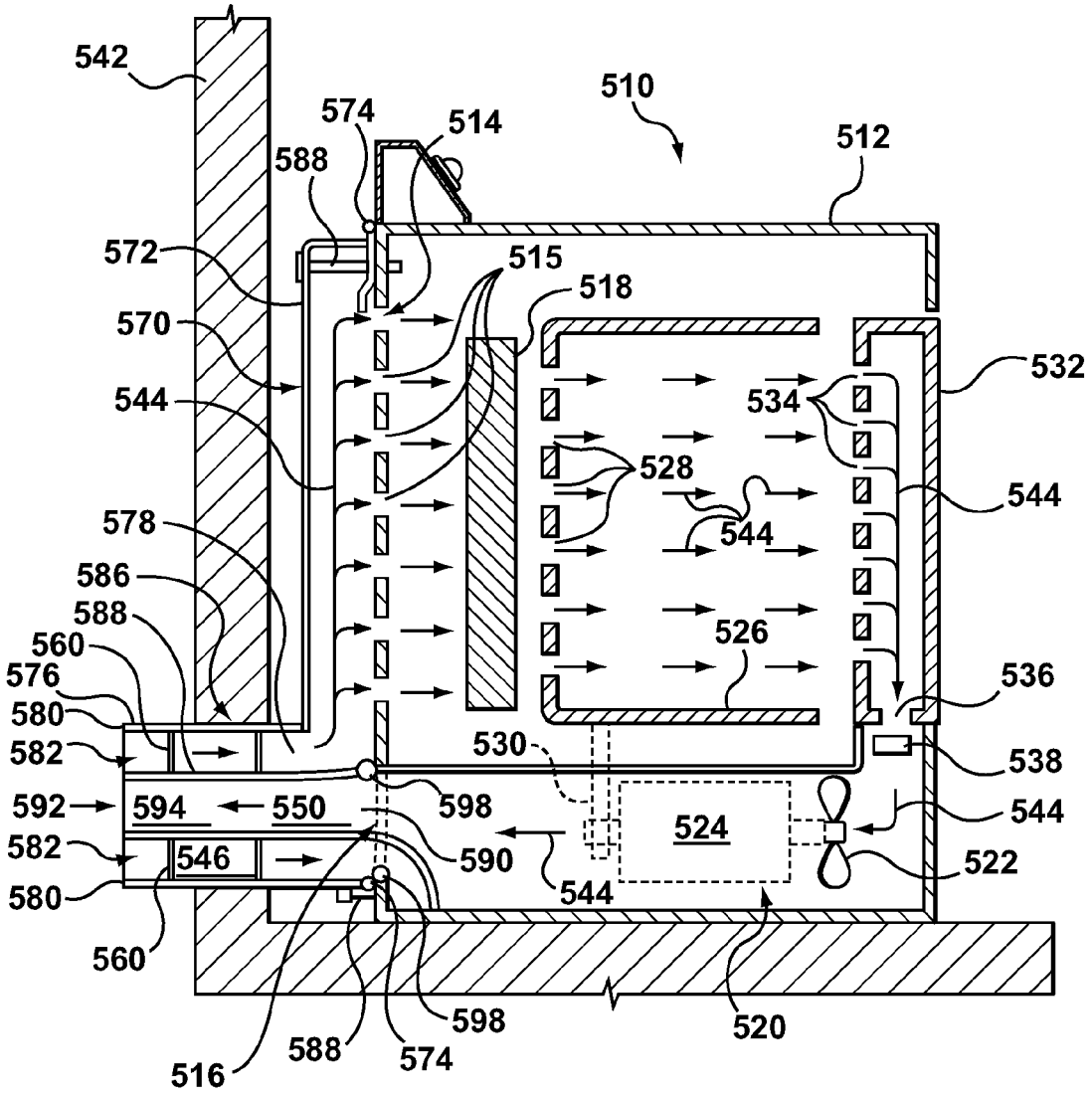
FIG. 5 is a schematic cross-sectional view of a third exemplary embodiment of an adaptor according to an aspect of the present invention secured to a conventional hot-air clothes dryer, shown in its surrounding environment.

Reference is now made to FIGS. 4 and 5, which show, respectively, a second and third exemplary adaptor according to an aspect of the present invention. The second exemplary adaptor is denoted by the reference numeral 470, and the third exemplary adaptor is denoted by the reference numeral 570. Both the second and third exemplary adaptors 470, 570 are designed to adapt a prior art hot-air clothes dryer such as that shown in FIG. 1B, and hence are illustrated in association with such a prior art hot-air clothes dryer, which is denoted by the reference numeral 410 in FIG. 4 and by the reference numeral 510 in FIG. 5. The prior-art clothes dryer 410, 510 is identical to the prior art clothes dryer 310 depicted in FIG. 3, and accordingly corresponding reference numerals are used to denote corresponding features, except with the prefix "4" or "5" instead of "3". In addition, the second and third exemplary adaptors 470, 570 are similar to the first exemplary adaptor 370, and as such, identical reference numerals are used to denote corresponding features, except with the prefix "4" or "5" instead of "3". The exterior wall is denoted by reference 442 and 542, and the flow of air is denoted by arrows 444 and 544.

In the first exemplary adaptor 370 shown in FIG. 3, the air intake linkage 376 is separate from, and extends through a different aperture in the exterior wall 342 than, the vent passage 340 defined by the linkage secured at the dryer air outlet 316. As such, the original vent passage 340 from the dryer 310 remained in place. In contrast, the second exemplary adaptor 470 and the third exemplary adaptor 570 each also include a respective air output linkage 488, 588 having a first end 490, 590 mounted or securable to the adaptor housing 472, 572 in sealing fluid communication with the dryer air outlet 416, 516 and a second end 492, 592 defining an outlet aperture 494, 594. The first end 490, 590 of the air output linkage 488, 588 is in fluid communication with the outlet aperture 494, 594 to define a sealed output air passage 450, 550 between the outlet aperture 494, 594 and the dryer air outlet 416, 516. As will be described in greater detail below, in the second and third exemplary adaptors 470, 570 the intake air passage 446, 546 and the output air passage 450, 550 each include concentrically arranged portions.

As can be seen in FIGS. 4 and 5, the adaptor housing 472, 572 is simultaneously securable over both the air intake region of the dryer 410, 510 and also over the air outlet region of the dryer 410, 510, that is, over the dryer air outlet 416, 516, so as to place the first end 490, 590 of the air output linkage 488, 588 in sealed fluid communication with the dryer air outlet 416. Such sealing may be achieved by any suitable technique; in the illustrated embodiments a resilient gasket 498, 598 is disposed at the edge of the first end 490, 590 of the air output linkage 488, 588.

Figure 1A:
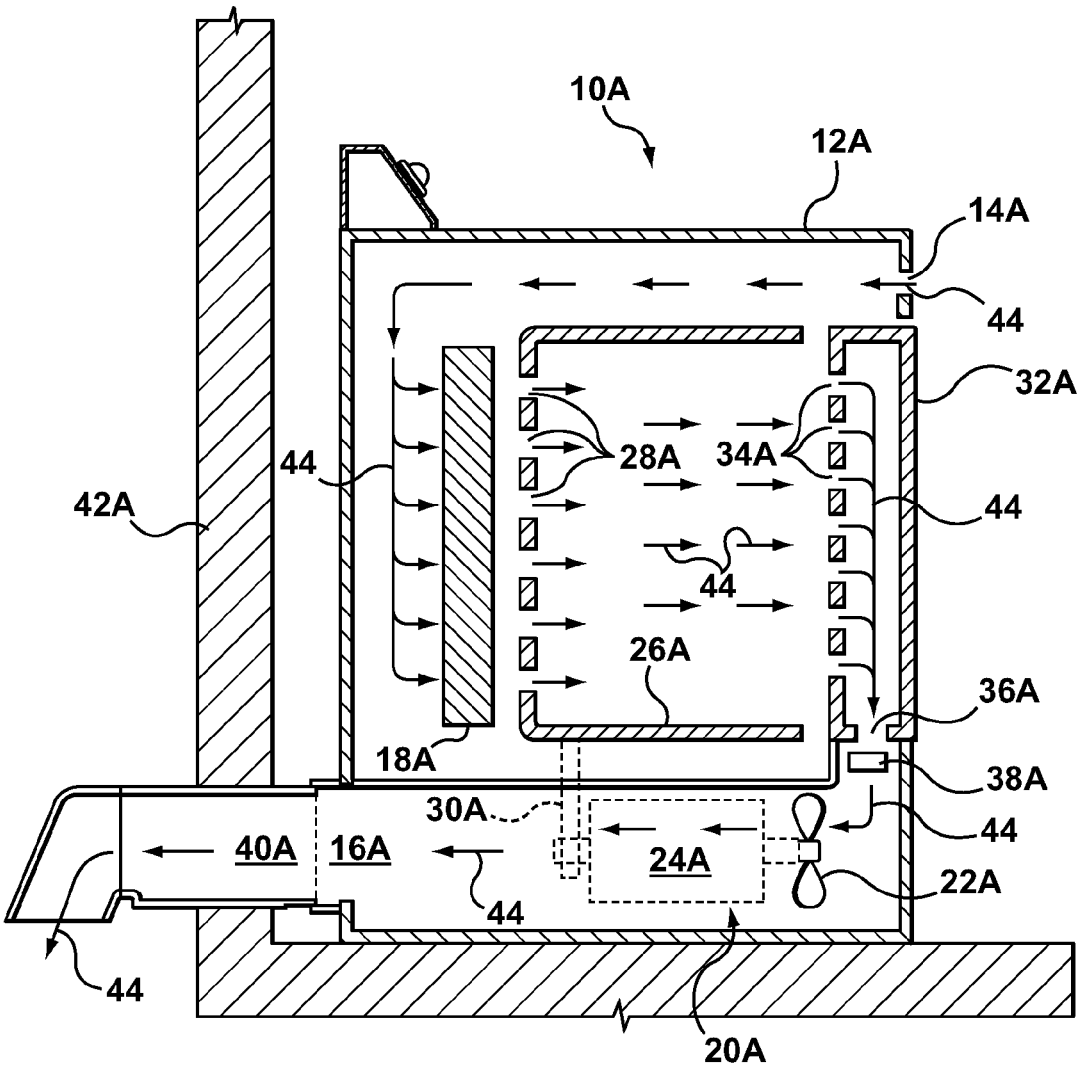
FIG. 1A (PRIOR ART)
FIG. 1A is a schematic cross-sectional view of a first prior art hot-air clothes dryer and its surrounding environment.
Figure 1B:
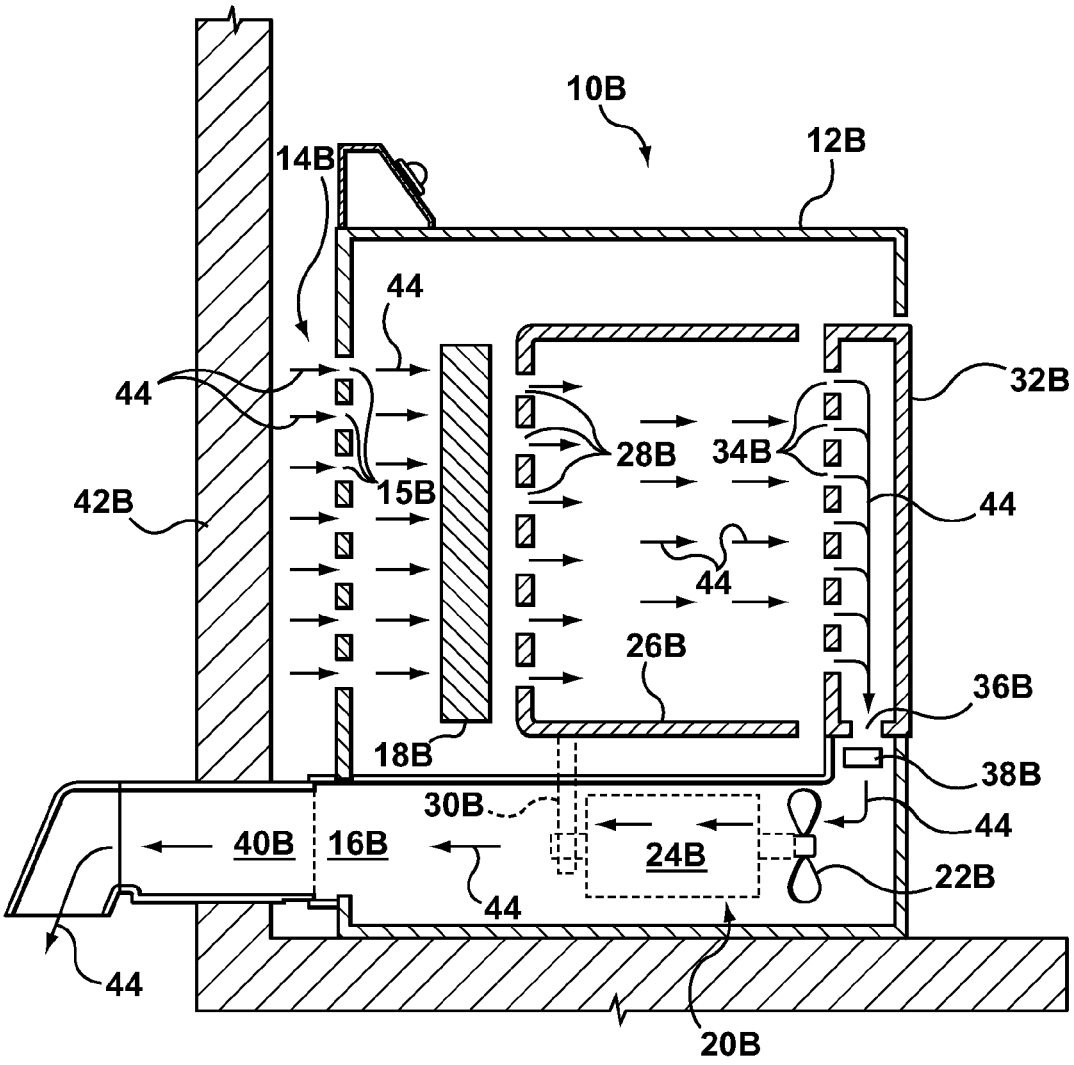
FIG. 1B (PRIOR ART)
FIG. 1B is a schematic cross-sectional view of a second prior art hot-air clothes dryer and its surrounding environment.
Figure 2:
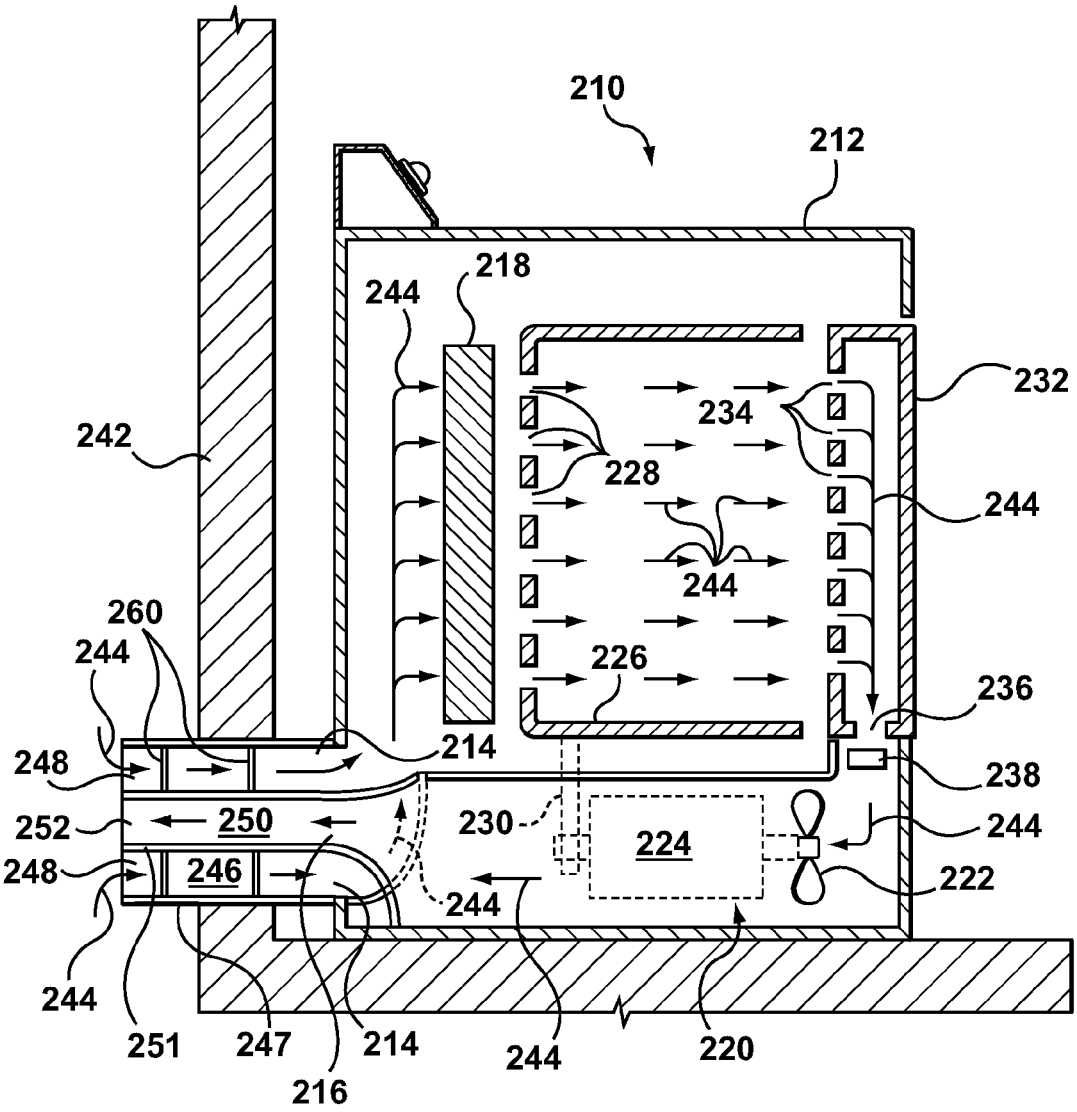
FIG. 2 (Prior Art)
FIG. 2 is a schematic cross-sectional view of a third prior art hot-air clothes dryer and its surrounding environment.

Thus, when installing either the second or third embodiments of the adaptors 470, 570 on a dryer such as that shown in FIG. 1B (e.g. dryer 510), the linkage defining the original vent passage 40 (FIG. 1B) would be removed, and the adaptor 470, 570 would be secured in position on the back of the dryer 410, with the adaptor housing 472, 572 secured over the dryer air inlet 414, 514 so that the first end 478, 578 of the air intake linkage 476, 576 is in sealed fluid communication with the dryer air inlet 514 and the first end 490, 590 of the air output linkage 488, 588 is in sealed fluid communication with the dryer air outlet 416, 516. This enables the existing aperture in the wall 442, 542 to be used, although it may need to be widened.

As noted above, in the second and third embodiment of the adaptor 470, 570, the intake air passages 446, 546 and the output air passages 450, 550 each include concentrically arranged portions. In the second exemplary adaptor 470 a portion of the air intake linkage 476 is disposed within, and surrounded by, the air output linkage 488 and supported by spokes 460. Conversely, in the third exemplary adaptor 570, a portion of the air output linkage 588 is disposed within, and surrounded by, the air intake linkage 576 and supported by spokes 560.

It is also within the contemplation of the inventors to provide an adaptor for dryers such as those shown in FIG. 1A; such adaptors would be similar to the adaptors described above with an adaptor housing shaped to sealingly engage the air intake 14A at the front of the dryer 10A. In such an embodiment, flexible tubing or other suitable connections may be used.

Figure 6A:
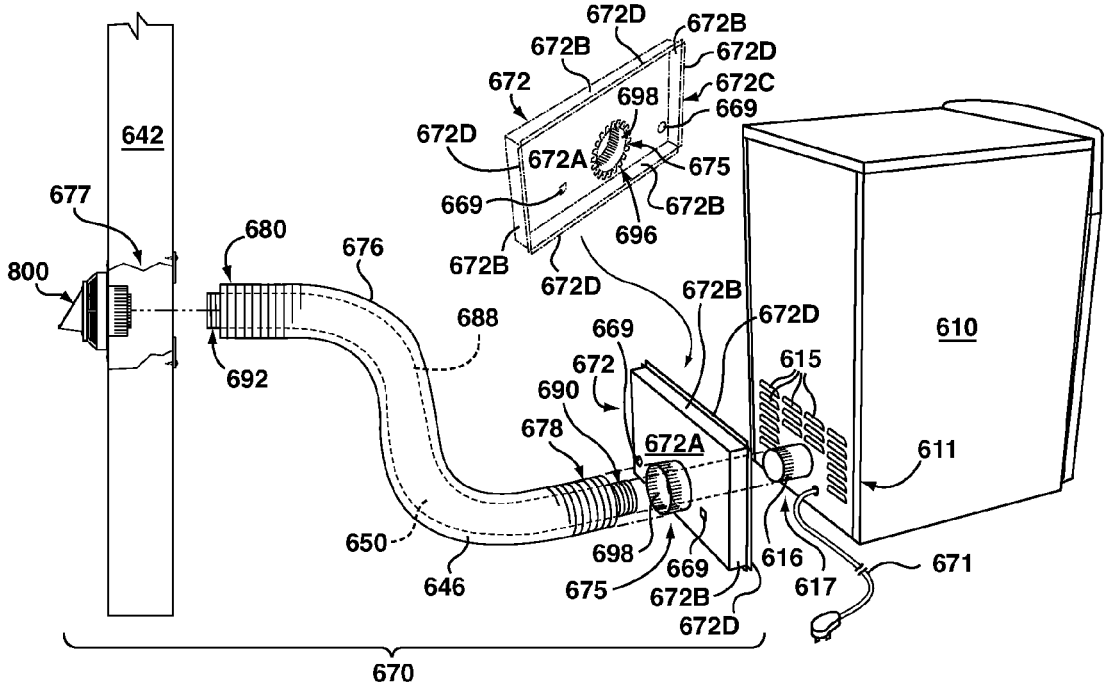
FIG. 6A is a partially exploded perspective view of a physical embodiment of the adaptor shown schematically in FIG. 5 together with its surrounding environment.
Figure 6B:
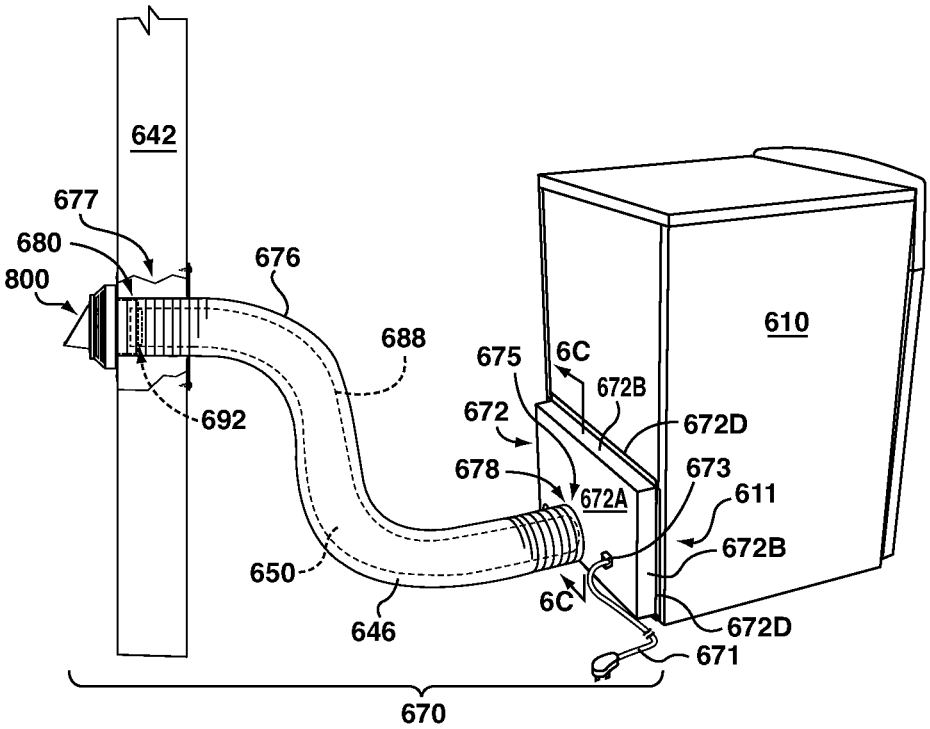
FIG. 6B is a perspective view of the adaptor and environment shown in FIG. 6A.
Figure 6C:
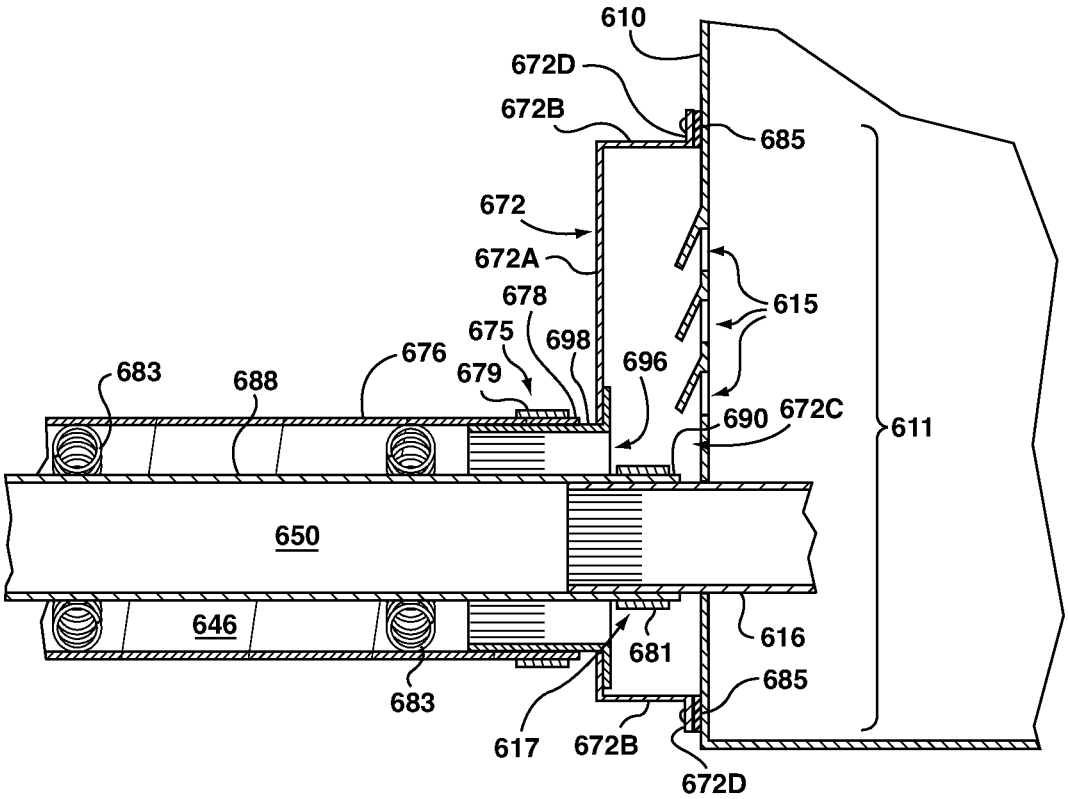
FIG. 6C is a cross-sectional view of a portion of the adaptor of FIG. 6A, taken along the line 6C-6C in FIG. 6B.

Reference is now made to FIGS. 6A to 6C. FIG. 6A is an exploded view showing assembly of an exemplary physical embodiment of an adaptor 670 of the general type shown schematically in FIG. 5 and mounting of the adaptor 670 onto a physical embodiment 610 of an exemplary hot-air clothes dryer 610 of the type shown schematically in FIG. 5. FIG. 6B shows a perspective view of the adaptor 670 fully assembled and mounted on the dryer 610, and FIG. 6C is a cross-sectional view of the portion of the adaptor 670 closest to the dryer 610.

The lower portion of the rear of the dryer 610 includes an air intake region 611 having a plurality of apertures 615 through which the dryer 610 would normally draw ambient air from the room in which it is located. The lower portion of the rear of the dryer 610 also includes an air outlet region 617 containing the air outlet 616 of the dryer 610. The air outlet 616 comprises a tubular extension, and in a conventional installation of the dryer 610 a suitable flexible ducting tube (not shown) would be sealingly coupled to the air outlet 616.

As best seen in FIG. 6A, the adaptor 670 comprises a parallelepipedic adaptor housing 672 having one open side 672C that is sealingly secured over the air intake region 611 of the dryer 610, as shown in FIG. 6B. Any suitable method may be used to secure the adaptor 670 to the dryer 610. Since the air intake region 611 encompasses the apertures 615 (not shown in FIG. 6B) that define the air inlet of the dryer 610, the adaptor housing 670 is thus in sealed fluid communication with the air inlet of the dryer 610. In addition to be being sealingly secured over the air intake region 611 of the dryer 610, the adaptor housing 672 is also simultaneously sealingly secured over the air outlet region 617 (not shown in FIG. 6B) of the dryer 610.

In the illustrated embodiment, the adaptor housing 672 is formed by a rectangular main face 672A and four side walls 672B extending from the edges of the main face 672A so as to define the open side 672C opposite the main face 672A. The side walls 672B terminate in outwardly extending mounting tabs 672D which are substantially parallel to the main face 672A. The adaptor housing 672 may be advantageously formed by cutting and bending a piece of sheet metal and then sealing the edges of adjacent side walls together, for example by welding or by use of adhesive sealing strips. The main face 672 of the adaptor housing 672 includes cord apertures 669 through which an electrical power cord 671 of the dryer 610 can extend when the adaptor 670 is mounted to the dryer 610. One cord aperture 669 is provided at each side of the main face 672A to accommodate different locations of the electrical power cord 671. Once the electrical power cord 671 has been passed through the cord aperture 669, the cord apertures 669 can be sealed, for example by way of suitable resilient closures 673 as shown in FIG. 6B.

The adaptor 670 has an adaptor housing inlet 675 formed by a circular aperture 696 in the main face 672A and into which a tubular section 698 is fitted and sealed so as to project outwardly from the main face 672A, that is, in the direction opposite from the direction in which the side walls 672B extend.

The adaptor housing inlet 675 is connected in sealed fluid communication with an air intake linkage 676 in the form of a flexible ducting tube 676 whose first end 678 is sealingly secured to the adaptor housing inlet 675 by sealingly connecting the first end 678 to the tubular section 698 on the adaptor housing 672, thereby placing the first end 678 of the air intake linkage 675 in sealed fluid communication, through the adaptor housing 672, with the air inlet of the dryer 610. The second end 680 of the air intake linkage 676 defines an inlet aperture which is in fluid communication with the first end 678 of the air intake linkage 675 to define an intake air passage 646 therebetween. The second end 680 of the air intake linkage 676 is coupled in fluid communication with the exterior of the building in which the dryer 610 is situated through an aperture 677 in an exterior wall 642 of the building, with the inlet aperture positioned to receive air only from outside the building. A dual-passage end-cap 800 is fitted to the aperture 677 in the exterior wall 642 and receives the second end 680 of the air intake linkage 676; the dual-passage end-cap 800 will be described in greater detail below.

The adaptor 670 also includes an air output linkage 688, also formed from a flexible ducting tube, and which is disposed concentrically inside the air intake linkage 676. The first end 690 of the air output linkage 688 extends through the adaptor housing inlet 675, that is, through the tubular section 698 on the adaptor housing 672, and is secured in sealed fluid communication with the air outlet 616 of the dryer 610 inside the adaptor housing 672. The second end 692 of the air output linkage 688 defines an outlet aperture in fluid communication with the first end 690 of the air output linkage 688, and thereby with the air outlet 616 of the dryer 610, such that the air output linkage 688 defines an output air passage 650 that is isolated from the intake air passage 646. More particularly, the output air passage 650 is the path along the inside of the air output linkage 676, and the air intake passage 646 is the path defined by the annular space between the wall of the air intake linkage 676 and the wall of the air output linkage 688. The second end 692 of the air output linkage 688 is also received by the dual-passage end-cap 800 and hence is disposed outside of the adaptor housing 672.

Reference is now made specifically to FIG. 6C. As can be seen, the first end 678 of the air intake linkage 676 is slidably received on the tubular section 698 of the adaptor housing 672, and held in place by an annular clamp 679. Similarly, the first end 690 of the air output linkage 688 is slidably received on the tubular air outlet 616 of the dryer 610 and held in place by an annular clamp 681. Alternatively, adhesive caulking or duct tape may be used in place of the annular clamps 679, 681. The air intake linkage 676 and air output linkage 688 are maintained in concentric arrangement with one another by a series of annular springs 683 spaced apart along the length of the air intake linkage 676 and air output linkage 688 and disposed between the outer surface of the air output linkage 688 and the inner surface of the air intake linkage 676 so as to act as spacers. A seal 685 is disposed between each of the mounting tabs 672D and the rear surface of the dryer 610.

Figure 6D:
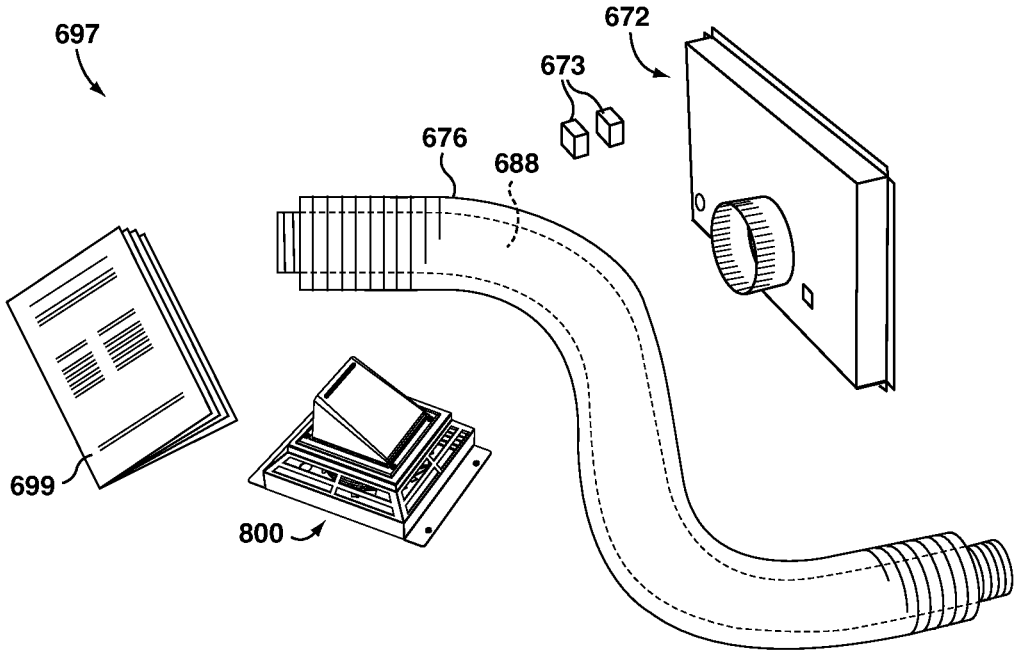
FIG. 6D shows a kit for assembling the adaptor of FIG. 6A.

FIG. 6D shows an adaptor kit 697 which may be packaged for sale to enable a purchaser to assemble and install an adaptor, such as the adaptor 670, for converting a hot-air dryer to draw air from outside the building in which it is located. The adaptor kit 697 comprises an adaptor housing 672, concentrically arranged air intake linkage 676 and air output linkage 688 with spacers (not shown in FIG. 6D), closures 673, a dual-passage end-cap 800 and instructions 699 for assembling the components into an adaptor and for securing the assembled adaptor to a dryer and also for installing the dual-passage end-cap 800 in the wall and coupling the air intake linkage 676 and air output linkage 688 thereto. The adaptor kit 697 may also include seals, clamps, duct tape or other ancillary components.

Referring now to FIGS. 8A to 8E, an exemplary embodiment of the dual-passage end-cap 800 is now described. The end cap comprises a main body 802, as well as an air intake tube 804, an air output tube 806 and a deflector cowl 808 having a downwardly opening exhaust aperture 838. Each of the air intake tube 804, air output tube 806 and deflector cowl 808 is carried by the main body 802.

Figure 8A:
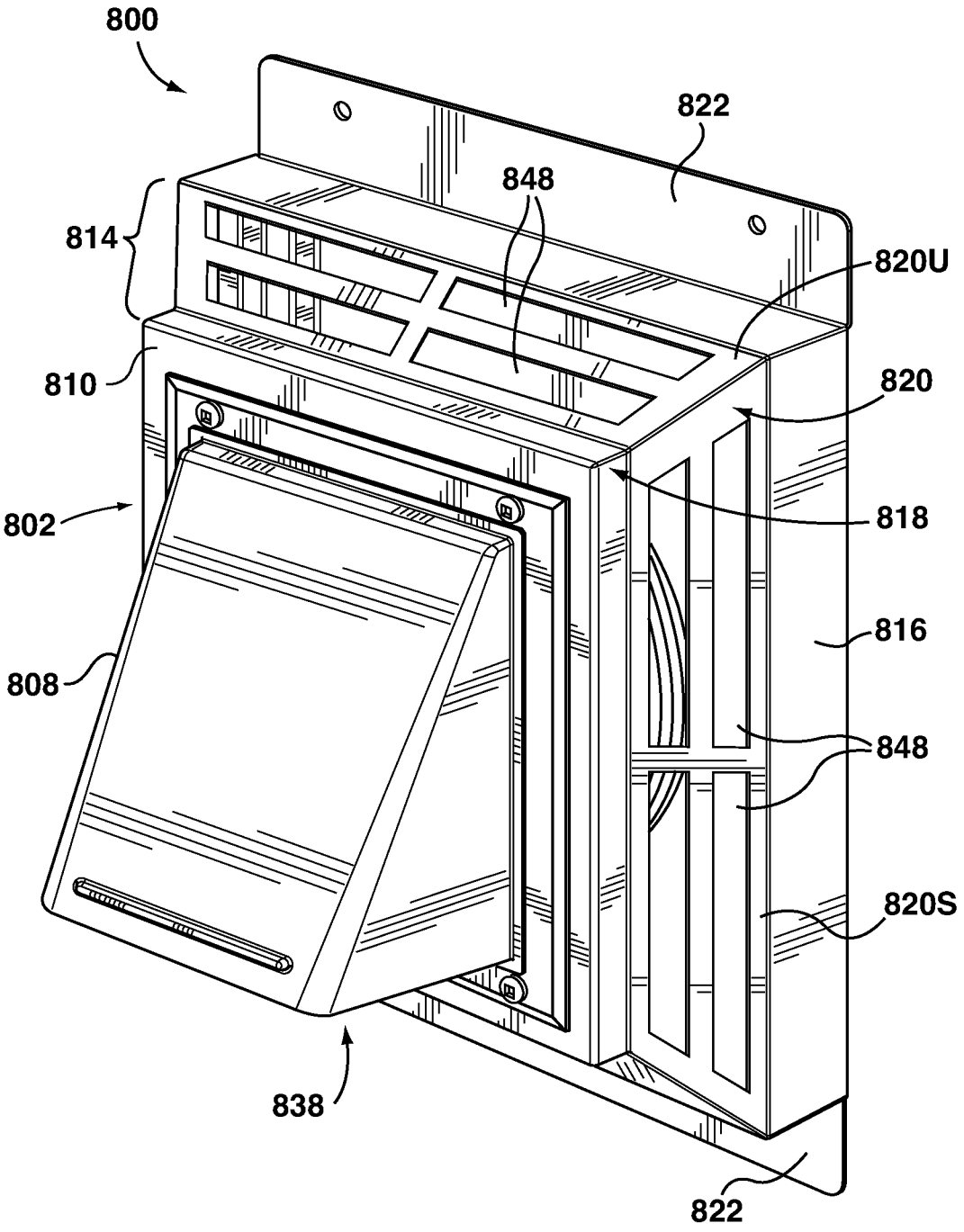
FIG. 8A is an upper front perspective view of an exemplary dual-passage end-cap according to an aspect of the present invention.
Figure 8B:
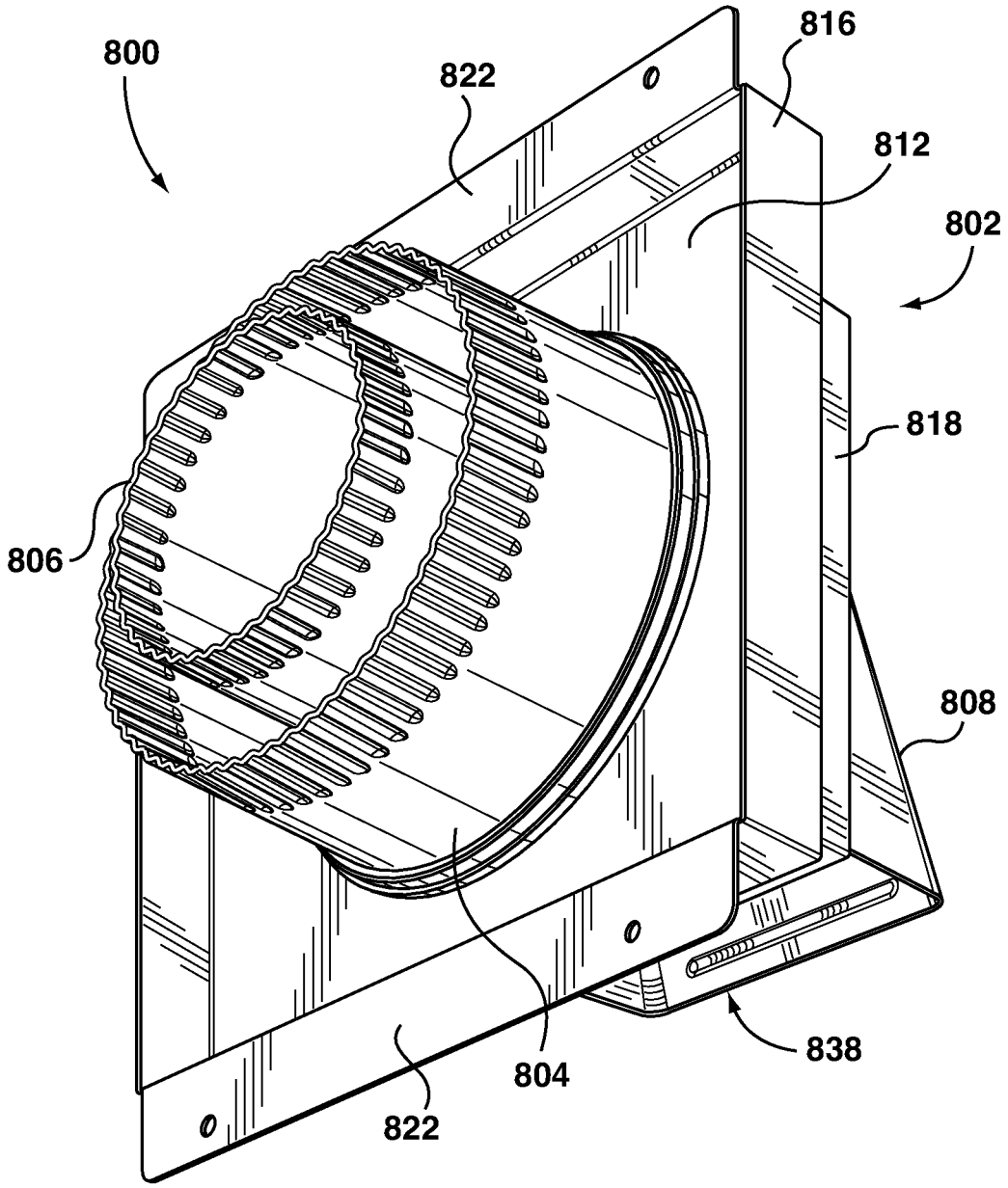
FIG. 8B is a lower rear perspective view of the dual-passage end-cap of FIG. 8A.
Figure 8C:
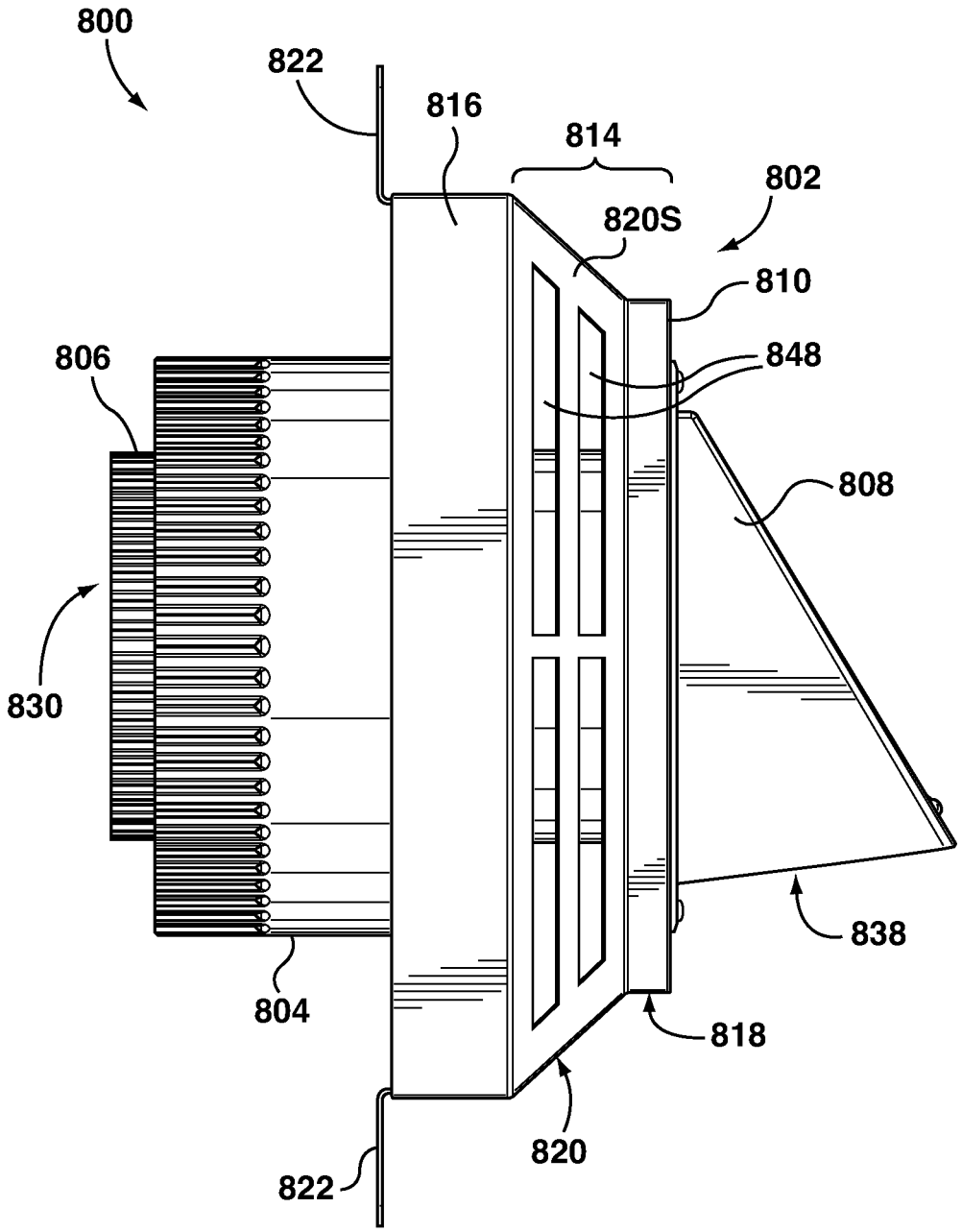
FIG. 8C is a side view of the dual-passage end-cap of FIG. 8A.
Figure 8D:
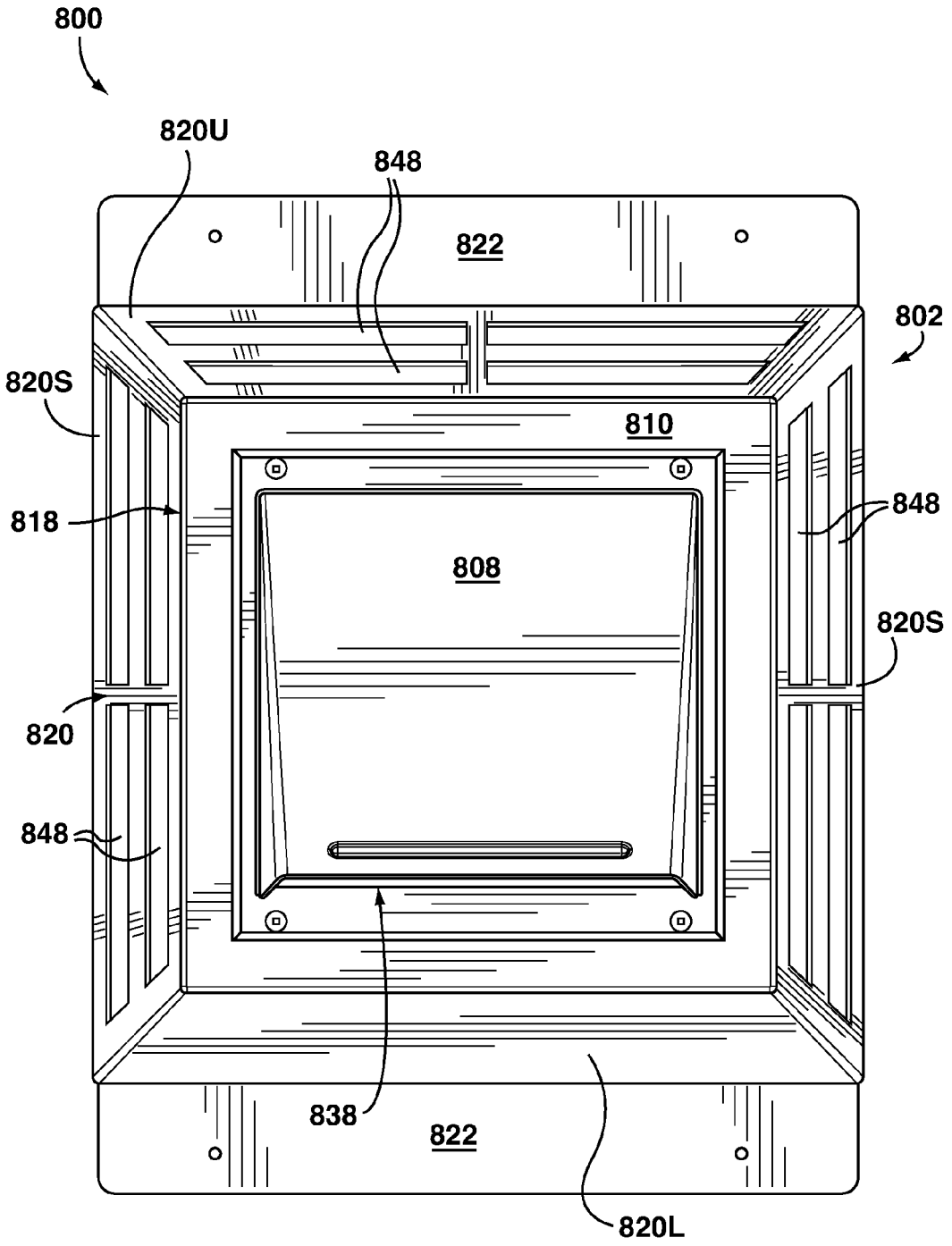
FIG. 8D is a front view of the dual-passage end-cap of FIG. 8A.

The main body 802 comprises a front face 810 and a rear face 812 spaced apart from one another by a wall section 814. The wall section 814 comprises a rectangular front portion 818 adjacent the front face 810 and a frusto-pyramidal rear portion 820 disposed between and tapering from the rear face 812 to the front portion 818. A skirt 816 depends from the rear face 812, away from the rear portion 820, and mounting flanges 822 are defined by outwardly bent portions of the skirt 816. A plurality of air intake vents 848 are disposed in the side surfaces 820S and upper surfaces 820U of the rear portion 820 of the wall section 814, enabling air to flow from outside the main body 802 into the interior volume 846 of the main body. No air intake vents are defined in the lower surface 820L of the rear portion 820, as best seen in FIG. 8D. The front face 810, wall section 814 and mounting flanges 822 can be formed by cutting and bending a piece of sheet metal and optionally securing the seams, such as by welding. If the seams are not sealed, they will simply function as additional air intake vents.

Figure 8E:
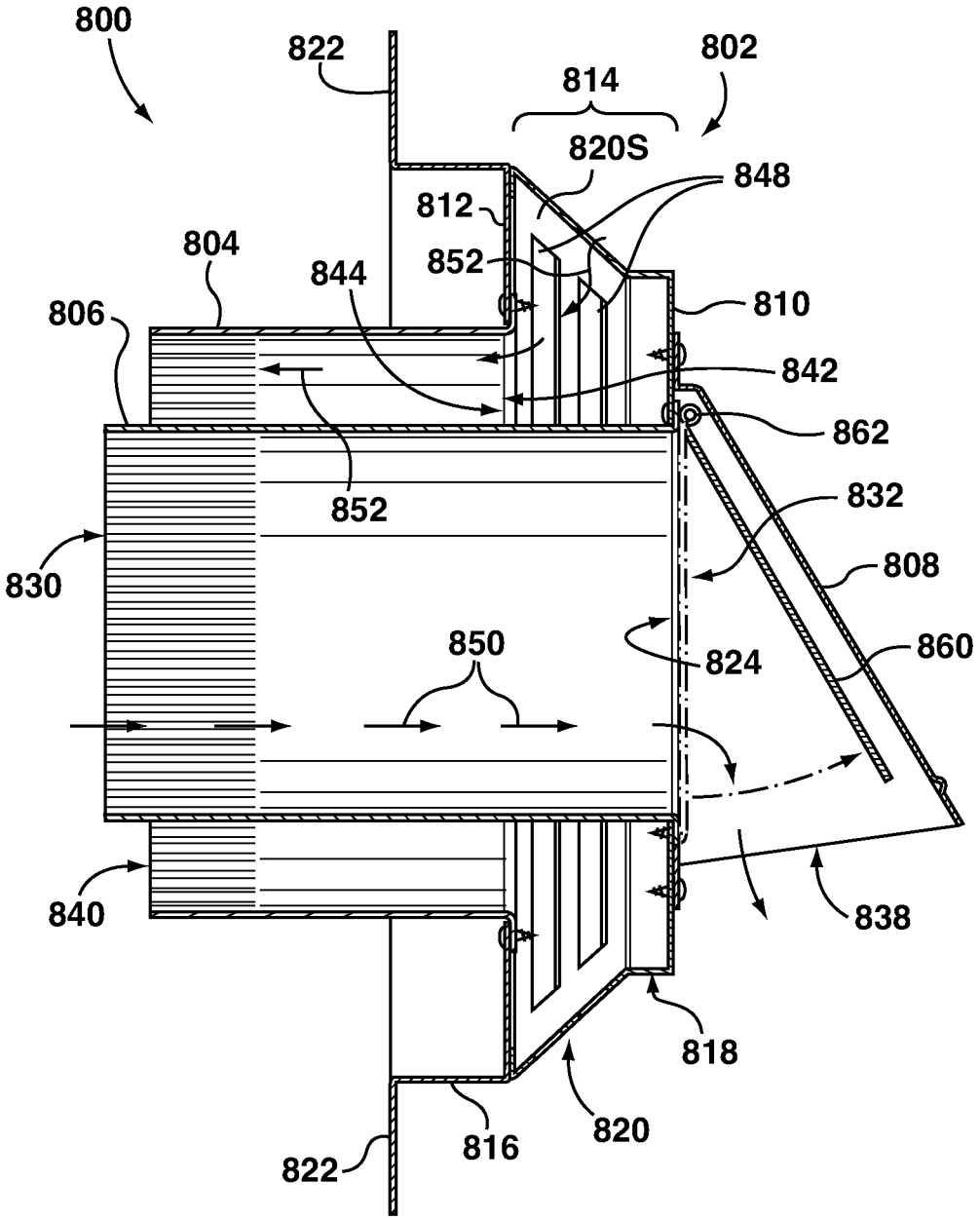
FIG. 8E is a side cross-sectional view of the dual-passage end-cap of FIG. 8A.

Reference is now made specifically to FIG. 8E. The air output tube 806 is longer than, and is disposed concentrically inside, the air intake tube 804. The air output tube 806 has an output connection end 830 and a discharge end 832, each of which extends beyond the air intake tube 804. The output connection end 830 of the air output tube 806 receives the second end 692 of the air output linkage 688 (not shown in FIGS. 8A to 8E), which may be sealingly secured to the output connection end 830 of the air output tube 806 by any suitable technique, such as an annular clamp, friction or interference fit, adhesive sealant or duct tape. The discharge end 832 of the air output tube 806 sealingly engages the front face 810 of the main body 802 in registration with an air output aperture 824 in the front face 810, which is in turn in registration with the deflector cowl 808. This permits air to flow from the output connection end 830 of the air output tube 806 through and out of the exhaust aperture 838 of the deflector cowl 808, as shown by the arrows 850 in FIG. 8E. Thus, when the second end 692 of the air output linkage 688 of an installed adaptor 670 is coupled to the output connection end 830 of the air output tube 806, as shown in FIG. 6B, the air outlet 616 of the dryer 610 communicates with the outside of the building via the air output linkage 688, the air output tube 806, the air output aperture 824 in the front face 810 and the deflector cowl 808. The dryer 610 can thereby exhaust moist heated air to outside the building.

The air intake tube 804 has an intake connection end 840 and an intake inlet end 842. The intake connection end 840 of the air intake tube 804 receives the second end 680 of the air intake linkage 676 (not shown in FIGS. 8A to 8E), which may be sealingly secured to the intake connection end 840 of the air intake tube 804 by any suitable technique, such as an annular clamp, friction or interference fit, adhesive sealant or duct tape. The intake inlet end 842 of the air intake tube 804 is in sealing engagement with the rear face 812 of the main body 802 and in registration with an air intake aperture 844 in the rear face 812 so that the air intake tube 804 communicates with the interior volume of the main body 802 through the air intake aperture 844, while the internal volume communicates with the ambient environment outside the building through the air intake vents 848. This permits air to flow from the air intake vents 848 through to the intake connection end 840 of the air intake tube 804, as shown by the arrows 852 in FIG. 8E Accordingly, when the second end 680 of the air intake linkage 676 of an installed adaptor 670 (not shown in FIGS. 8A to 8E) is coupled to the intake connection end 840 of the air intake tube 804, as shown in FIG. 6B, the air outlet air intake region 611 of the dryer 610, and hence the air intake apertures 615, communicates with the outside of the building via the air intake linkage 676, the air intake tube 804, the air intake aperture 844 in the rear face 812 and the air intake vents 848. The dryer 610 can thereby draw fresh air directly from outside the building.

As shown in FIG. 8E, a closure flap 860 is hingedly mounted to the front face 810, inside the deflector cowl 808, with the hinge 862 positioned above the air output aperture 824 in the front face 810. When the dryer to which the dual-passage end-cap 800 is not in use, no air will flow through the air output tube 806 and the air output aperture 824, and the closure flap 860 will hang vertically from the hinge 862 to obstruct the air output aperture 824 and inhibit the ingress of animals such as birds and squirrels. When the dryer to which the dual-passage end-cap 800 is in use, air flowing through the air output tube 806 and the air output aperture 824 will blow the closure flap 860 outwardly, enabling the air to be exhausted through the exhaust aperture 838 in the deflector cowl 808. Alternatively, a screen may be used to prevent animal ingress.

In the first adaptor embodiment 270, the intake air passage 246 was defined by a linkage 247 that was separate from the linkage defining the output air passage 240 and hence the intake air passage 246 was isolated from the output air passage 240.

In the exemplary second and third adaptor embodiments 470 and 570, and in the physical embodiment 670, the respective output air passage 450, 550, 650 although including portions concentric with the respective intake air passage 446, 546, 646 is still is isolated therefrom in the sense that the two passages do not communicate directly with one another. Air in the respective intake air passage 446, 546, 646 cannot reach the respective output air passage 450, 550, 650 except by passing through the respective dryer 410, 510, 610 and air in the respective output air passage 450, 550, 650 cannot reach the intake air passage 446, 546, 646 except by exiting the outlet aperture and re-entering the inlet aperture which may occur to a limited extent. Notwithstanding the possibility that some air that has been expelled from the outlet aperture may be drawn into the inlet aperture this is because both the outlet aperture and the inlet aperture communicate with the ambient environment; they do not communicate directly with one another.

Moreover, the design of the dual-passage end-cap 800 inhibits air exhausted from a dryer from being drawn back into the dryer. As noted above, the air intake vents 848 into the dual-passage end-cap 800 are disposed in the side surfaces 820S and upper surfaces 820U of the rear portion 820 of the wall section 814, but not in the lower surface 820L thereof. As a result, the downwardly opening exhaust aperture 838 of the deflector cowl 808 will direct exhausted air away from the air intake vents 848.

Figures 7A, 7B:
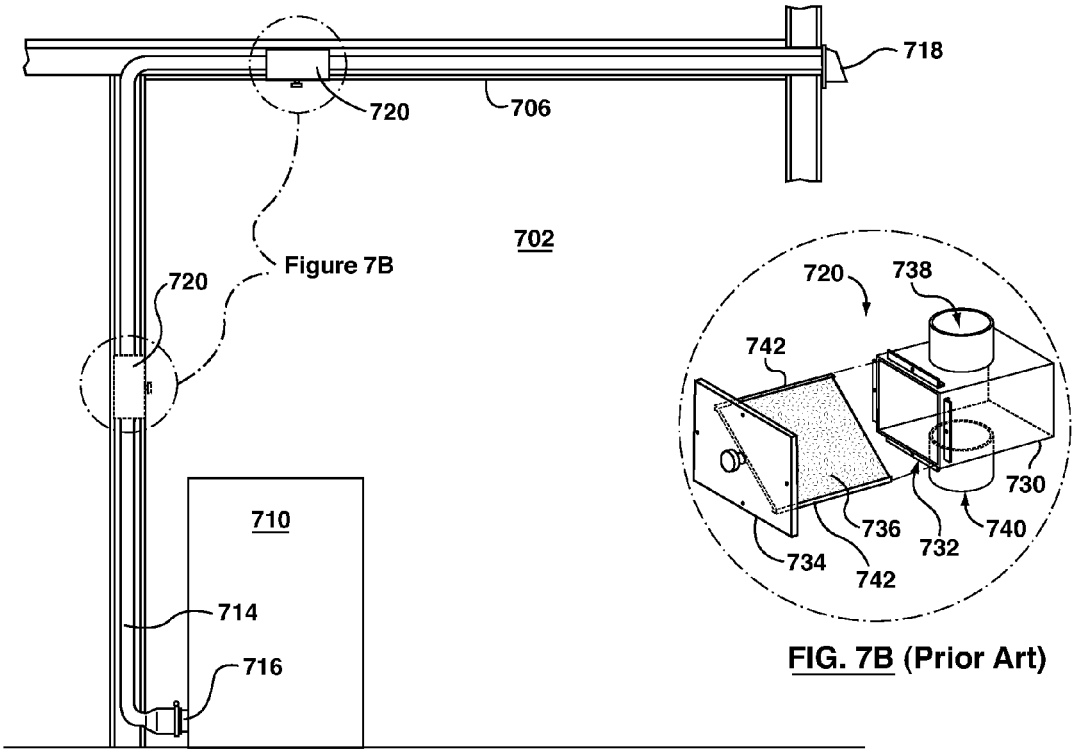
FIG. 7B (Prior Art)
FIG. 7A (Prior Art)
FIG. 7A shows a room in which a dryer is installed and which includes prior art external lint traps in the wall and ceiling of the room.
FIG. 7B is an exploded perspective view of one of the lint traps of FIG. 7A.
Figure 7C:
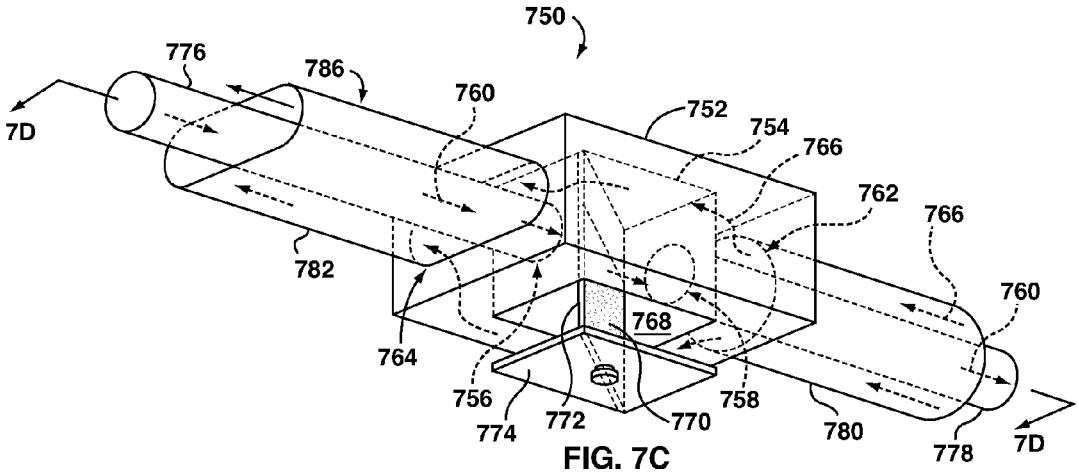
FIG. 7C is a bottom perspective view of an exemplary filter and filter bypass assembly according to an aspect of the present invention.
Figure 7D:
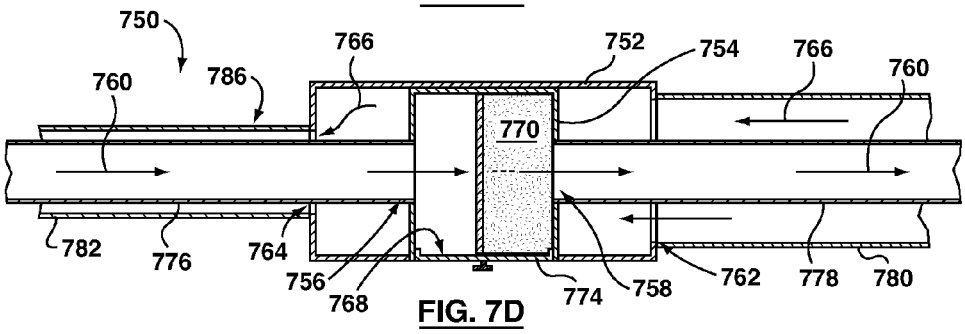
FIG. 7D is a cross-sectional view of the filter and filter bypass assembly of FIG. 7C, taken along the line 7D-7D in FIG. 7C.

An adaptor according to an aspect of the present invention, such as the adaptor 670 shown in FIGS. 6A to 6D, can be used in conjunction with a filter and filter bypass assembly according to another aspect of the present invention, with the filter portion of the assembly serving as an external lint trap. As shown in FIGS. 7C and 7D, an exemplary filter and filter bypass assembly 750 comprises an outer enclosure 752 and an inner enclosure 754 disposed inside the outer enclosure 752. The inner enclosure 754 has an opposed inner enclosure inlet 756 and inner enclosure outlet 758, and the outer enclosure 752 has an opposed outer enclosure inlet 762 and outer enclosure outlet 764. The inner enclosure 754 and the outer enclosure 752 have a common aperture 768 for insertion of a filter, and a filter member 770 is slidingly received in the inner enclosure 754, through the common aperture 768, with the edges 772 of the filter member 770 engaging inner surfaces of the inner enclosure 754, in particular the corners thereof. The filter member 770 is secured to a filter door 774 so that when the filter member 770 is inserted into the inner enclosure 754, the filter door 774 closes the common aperture 768. Although shown as diagonally mounted across the filter door 774, the filter member may have any suitable configuration, and may comprise multiple filters secured to one another or to the filter door 774 or both.

A first air output linkage 776 is sealingly coupled to the inner enclosure inlet 756, and a second air output linkage 778 is sealingly coupled to the inner enclosure outlet 758. Similarly, a first air intake linkage 780 is sealingly coupled to the outer enclosure inlet 762 and a second air intake linkage 782 is sealingly coupled to the outer enclosure outlet 764. Outside of the outer enclosure 752, the first air output linkage 776 is disposed inside the first air intake linkage 780 and the second air output linkage 778 is disposed inside the second air intake linkage 782, similarly to the air intake linkage 676 and air output linkage 688 described above. The first air intake linkage 780 includes a portion 786 of oval cross-section which enables it to better fit inside a wall and/or ceiling, while the second air intake linkage 782 is of circular cross-section. Both the first air output linkage 776 and the second air output linkage 778 are of circular cross-section.

The first air output linkage 776, inner enclosure inlet 756, inner enclosure 754, inner enclosure outlet 758 and second air output linkage 778 cooperate with one another to define a first airflow path, denoted by arrows 760, which passes through the inner enclosure 754 and hence through the filter member 770. The first air intake linkage 780, outer enclosure inlet 762, outer enclosure 752, outer enclosure outlet 764 and second air intake linkage 782 cooperate to define a second airflow path, denoted by arrows 766, through the outer enclosure and which bypasses the inner enclosure 754.

Figure 7E:
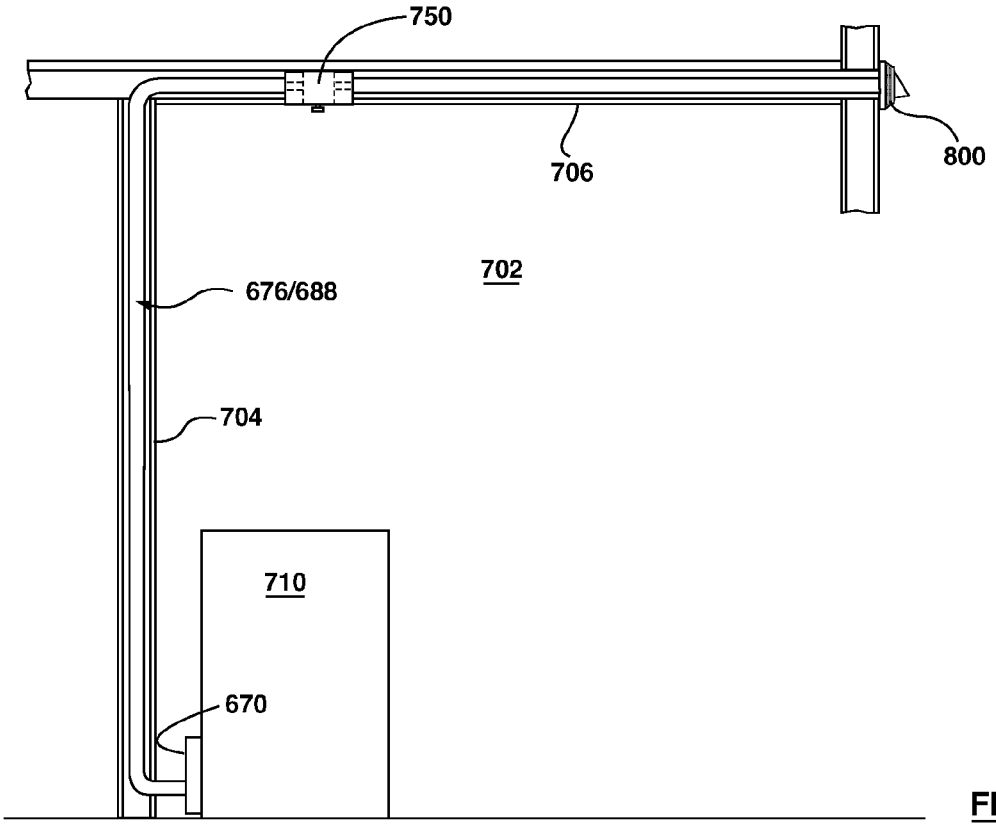
FIG. 7E shows a room in which a dryer having the adaptor of FIG. 6A is installed and which includes the filter and filter bypass assembly of FIG. 7C.

The filter and filter bypass assembly 750 may be used in cooperation with an adaptor according to an aspect of the present invention, such as adaptor 670. For example, the first air intake linkage 780 may be coupled to, or be a continuation of, the air intake linkage 676 of the adaptor 670, and the first air output linkage 776 may be coupled to, or be a continuation of, the air output linkage 688. Similarly, the second air output linkage 778 and second air intake linkage 782 may be coupled to a dual-passage end-cap 800 as described above. Thus, a dryer can draw air from outside the building via the second airflow path, denoted by arrows 766, which bypasses the inner enclosure 754 and is therefore unobstructed by the filter member 770 while exhausting air along the first airflow path, denoted by arrows 760, which passes through the inner enclosure 754 and therefore through the filter member 770 to trap lint. FIG. 7E shows a room 702 in which is situated a dryer 710 having an adaptor 670 installed thereon, with the adaptor 670 incorporating a ceiling-mounted filter and filter bypass assembly 750 coupled to the air intake linkage 676 and air output linkage 688 of the adaptor 670 so as to form a complete system.

As used herein, the terms "seal", "sealed", "sealingly" and the like are not meant to imply a perfect or hermetic seal, but rather an ordinary seal suitable for the purpose of substantially inhibiting unwanted air leakage. For example, the seal 685 between the adaptor housing 672 and air intake region 611 of the dryer 610 shown in FIG. 6C need not be a perfect or hermetic seal, but merely sufficient that substantially all of the air drawn through the air intake apertures 615 will come from the air intake linkage 676 rather than the surrounding room, even if a small portion of air is drawn from the room.

Several currently preferred embodiments have been described by way of example. It will be apparent to persons skilled in the art that a number of variations and modifications can be made without departing from the scope of the invention as defined in the claims. For example, adaptors according to aspects of the present invention can be made to accommodate dryers having various physical configurations other than those specifically illustrated herein while remaining within the scope of the claims.

What is claimed is:

1. A filter and filter bypass assembly, comprising:

an outer enclosure;

an inner enclosure inside the outer enclosure;

the inner enclosure having an inner enclosure inlet and an inner enclosure outlet defining a first airflow path through the inner enclosure;

the outer enclosure having an outer enclosure inlet and an outer enclosure outlet defining a second airflow path through the outer enclosure and bypassing the inner enclosure;

the inner enclosure and the outer enclosure having a common aperture for insertion of a filter into the inner enclosure across the first airflow path.

2. The filter and filter bypass assembly of claim 1, further comprising:

a filter member slidingly received in the inner enclosure with edges of the filter member engaging inner surfaces of the inner enclosure;

the filter member secured to a filter door so that when the filter member is inserted into the inner enclosure, the filter door closes the common aperture.

3. The filter and filter bypass assembly of claim 2, further comprising:

a first air output linkage sealingly coupled to the inner enclosure inlet; and a second air output linkage sealingly coupled to the inner enclosure outlet.

4. The filter and filter bypass assembly of claim 3, further comprising:

a first air intake linkage sealingly coupled to the outer enclosure inlet; and a second air intake linkage sealingly coupled to the outer enclosure outlet.

5. The filter and filter bypass assembly of claim 4, wherein:

a portion of the first air output linkage disposed outside of the outer enclosure is disposed inside the first air intake linkage; and a portion of the second air output linkage disposed outside of the outer enclosure is disposed inside the second air intake linkage.

* * * * *